US010249271B2

(12) United States Patent
Francisco Jose

(10) Patent No.: US 10,249,271 B2
(45) Date of Patent: Apr. 2, 2019

(54) MUTE FOR A RECORDER

(71) Applicant: Juarez Salas Francisco Jose, Seville (ES)

(72) Inventor: Juarez Salas Francisco Jose, Seville (ES)

( * ) Notice: Subject to any disclaimer, the term of this patent is extended or adjusted under 35 U.S.C. 154(b) by 0 days.

(21) Appl. No.: 15/742,500

(22) PCT Filed: Apr. 28, 2016

(86) PCT No.: PCT/ES2016/070320

§ 371 (c)(1),
(2) Date: Jan. 6, 2018

(87) PCT Pub. No.: WO2017/029420

PCT Pub. Date: Feb. 23, 2017

(65) Prior Publication Data

US 2018/0204547 A1 Jul. 19, 2018

(30) Foreign Application Priority Data

Aug. 18, 2015 (ES) ..... 201530954 U

(51) Int. Cl.
*G10D 9/06* (2006.01)
*G10D 7/02* (2006.01)

(52) U.S. Cl.
CPC ..... *G10D 9/06* (2013.01); *G10D 7/023* (2013.01)

(58) Field of Classification Search
CPC ..... G10D 9/06; G10D 7/023
See application file for complete search history.

(56) References Cited

U.S. PATENT DOCUMENTS

2010/0031801 A1* 2/2010 Montemurro ..... G10D 7/023 84/400

OTHER PUBLICATIONS

"Sordinella_Adjustable_Mute" (Oct. 30, 2012); URL: https://web_archive.org/web/20121030305903/http:/www.sordinella.it/index2.htm.

"Saundersrecorders_Mute_DIY" (Oct. 24, 2014), URL: https://web.archive.org/web/20141024003114/http:/www.saundersrecorders.com/mute02.htm.

* cited by examiner

*Primary Examiner* — Kimberly R Lockett
(74) *Attorney, Agent, or Firm* — John Alumit

(57) ABSTRACT

The present invention relates to a device which is introduced into the window of the mouthpiece, between the mouthpiece and the bevel, and which allows the volume of the sound produced by the recorder to be reduced, slightly affecting the quality of the sounds produced by same.

3 Claims, 2 Drawing Sheets

MUTE FOR A RECORDER

OBJECT OF THE INVENTION

The object of the present invention is a device that is inserted in the window of the mouthpiece, between the mouthpiece and the bevel, and that allows to reduce the volume of the sound produced by the flute, slightly affecting the quality of the sounds it produces.

BACKGROUND OF THE INVENTION

The interpreters of musical pieces need to repeatedly rehearse the pieces they have to perform, for this there are soundproofed enclosures or dedicated exclusively to this type of essays, in which the interpreter does not bother other people. This type of enclosures are usually used mainly by professionals. But in many occasions it is necessary that the rehearsals are developed in the private homes of the interpreters, especially when the interpreter is a student of a conservatory or a school or are self-taught, these rehearsals bother the neighbors because the piece or fragments thereof have to be repeated many times, because of the quality of the interpretation and of the volume of the music that can not be regulated.

The annoyances described in the previous paragraph have been borne by all those who have members of their family or neighbors who are learning or perfecting their interpretive technique with any musical instrument, especially with the recorder that is a cheap instrument and that occupies little space, for which is very used for the initiation in the music of children in schools.

The present invention provides a device that is coupled to a flute and that reduces the volume of the sounds produced by the flute, affecting slightly its sound quality, so that the flute can be played without disturbing the people nearby or the neighbors.

DESCRIPTION OF THE INVENTION

The mute for recorder, object of the present invention, consists of a sheet that has removable fastening means to the mouth of the recorder, said sheet is intended to be inserted in the window of the recorder and its thickness is less than the length of the recorder window measured in the direction of the revolution axis of the recorder, the width of said sheet is less than the length of the sharp edge of the bevel of the recorder, and the length of the aforementioned sheet is greater than the radial distance between the outer surface of the recorder mouth and the sharp edge of the recorder bevel, and the face of said sheet intended to be facing the recorder mouth is convex from the point of view of said mouth.

Preferred Embodiment

Figure 1:
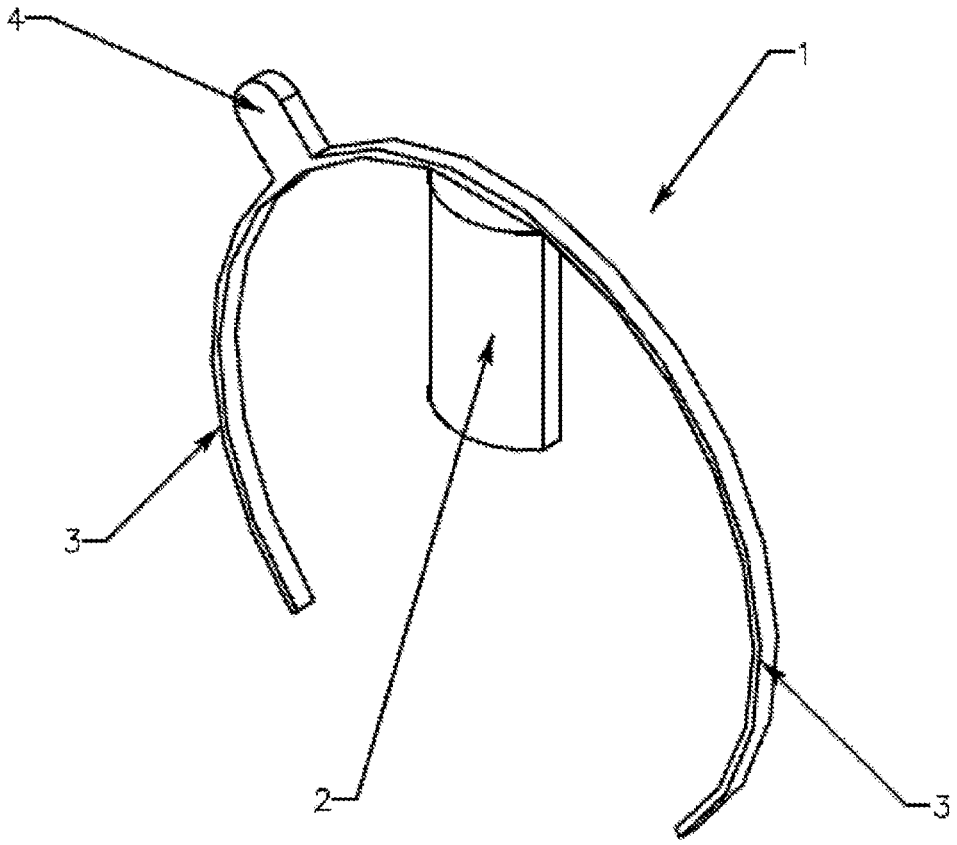
FIG. 1: shows a perspective view of the mute for recorder.
Figure 2:
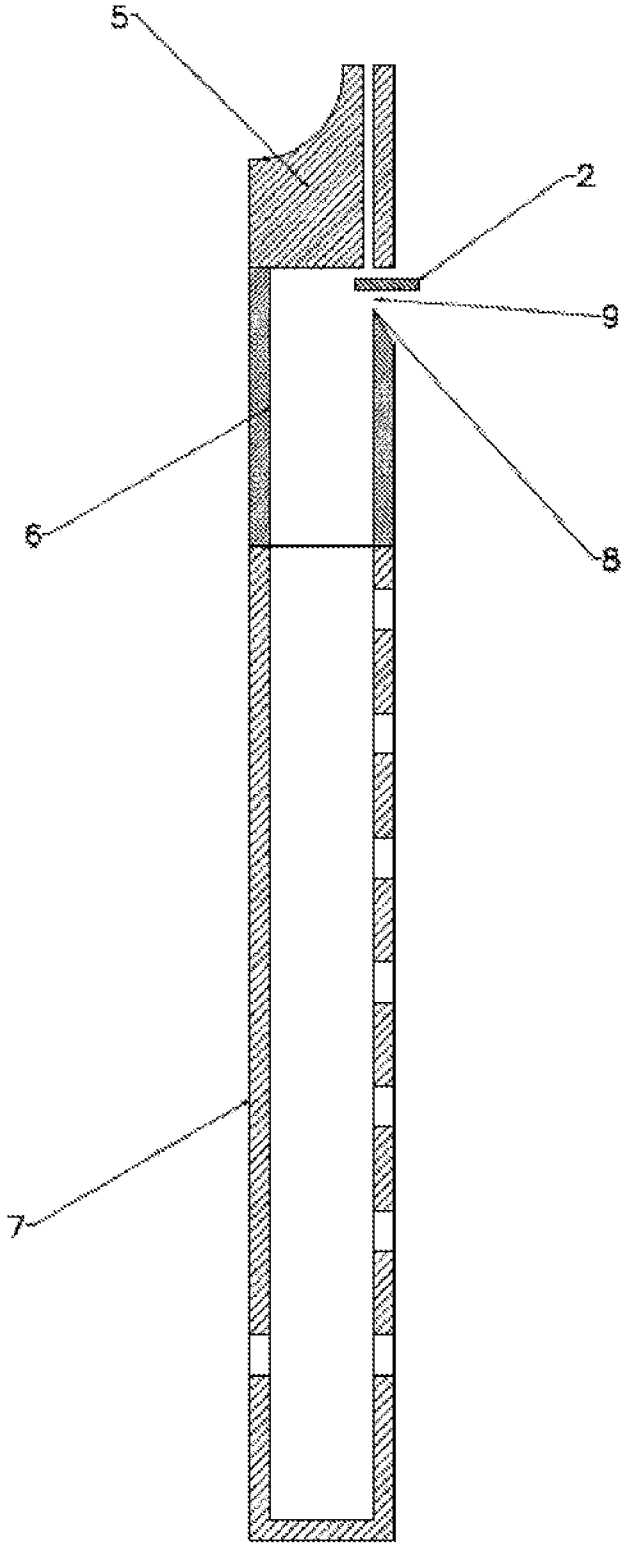
FIG. 2: shows a longitudinal section of a flute in which the mute for recorder has been coupled.

FIGS. 1 and 2 show a preferred embodiment of the mute (1) for recorder, object of the present description.

As is well known, a recorder produces sounds by striking a stream of air with a sharp edge, called a bevel (8), located in a window (9) arranged in the head (6), other elements of a recorder are the mouth (5) and the body (7), the different notes are achieved by plugging the holes of the body and therefore varying the properties of the air column inside the body, against which the blown air hits the mouth.

The mute (1) for recorder consists of a sheet (2) that has removable fixing means (3) to the recorder mouth, said sheet is intended to be inserted in the window (9) of the recorder, and its thickness is less than the length of the recorder window measured in the direction of the revolution axis of the recorder, the width of said sheet is less than the length of the sharp edge of the recorder bevel (8), and the length of said sheet is greater than the radial distance between the outer surface of the recorder mouth and the sharp edge of the recorder bevel, and the face of said sheet intended to be facing the recorder mouth is convex from the point of view of the mouth, so as to obtain the maximum reduction of the distortions in the produced sounds.

In a first design option, the removable fastening means (3) to the recorder mouth consist of two identical bands of semirigid material, and arranged symmetrically with respect to the longitudinal axis of the sheet, each of the bands has an approximate shape of an arc of circumference, and its length is less than half the length of the outer circumference of the recorder mouth, and to facilitate the coupling of the recorder mute, one or more of the bands may be provided with a handle.

The invention claimed is:

1. A mute for a recorder consisting of a convex sheet, adapted to be inserted into a recorder window, and attached to two identical bands of semi-rigid material that are removably affixed to a recorder mouth, said identical bands arranged symmetrically with respect to the longitudinal axis of the sheet, each of the bands having an approximate shape of an arc with a circumference and length that is less than half the length of the outer circumference of a mouth of the recorder.

2. The mute of claim 1 wherein at least one of the two identical bands has a handle.

3. The mute of claim 1, wherein the face of said sheet facing the recorder mouth is convex from the point of view of the mouth.

* * * * *